US008387298B2

(12) United States Patent
Kincel

(10) Patent No.: US 8,387,298 B2
(45) Date of Patent: Mar. 5, 2013

(54) FIREARM BUTTSTOCK ASSEMBLY AND METHOD

(75) Inventor: Eric S. Kincel, Tucson, AZ (US)

(73) Assignee: Abrams Airborne Manufacturing, Inc., Tucson, AZ (US)

( * ) Notice: Subject to any disclaimer, the term of this patent is extended or adjusted under 35 U.S.C. 154(b) by 0 days.

(21) Appl. No.: 13/341,448

(22) Filed: Dec. 30, 2011

(65) Prior Publication Data

US 2012/0186124 A1 Jul. 26, 2012

Related U.S. Application Data

(62) Division of application No. 12/411,610, filed on Mar. 26, 2009, now Pat. No. 8,087,193.

(51) Int. Cl.
*F41C 23/00* (2006.01)

(52) U.S. Cl. ..... 42/74; 42/72; 42/73; 42/71.01

(58) Field of Classification Search ..... 42/72, 73, 42/74, 71.01
See application file for complete search history.

(56) References Cited

U.S. PATENT DOCUMENTS

| | | | | |
|---|---|---|---|---|
| 666,564 | A * | 1/1901 | Shaw | 42/74 |
| 856,016 | A * | 6/1907 | Balson | 42/71.01 |
| 1,255,566 | A * | 2/1918 | Pearson | 42/74 |
| 1,328,700 | A * | 1/1920 | Wagoner | 42/74 |
| 2,438,142 | A * | 3/1948 | Brower | 42/74 |
| 4,788,785 | A * | 12/1988 | White | 42/72 |
| 5,970,642 | A * | 10/1999 | Martin | 42/73 |
| 6,305,115 | B1 * | 10/2001 | Cook | 42/74 |
| 6,311,423 | B1 * | 11/2001 | Graham | 42/74 |
| 6,655,068 | B2 * | 12/2003 | Murello et al. | 42/74 |
| 2004/0144011 | A1 * | 7/2004 | Vignaroli et al. | 42/74 |
| 2006/0174532 | A1 * | 8/2006 | Popikow | 42/73 |
| 2008/0028662 | A1 * | 2/2008 | Abraham et al. | 42/73 |
| 2010/0205846 | A1 * | 8/2010 | Fitzpatrick et al. | 42/73 |
| 2010/0281727 | A1 * | 11/2010 | Quaedpeerds et al. | 42/1.06 |
| 2011/0173863 | A1 * | 7/2011 | Ingram | 42/73 |

* cited by examiner

*Primary Examiner* — Samir Abdosh
(74) *Attorney, Agent, or Firm* — Fay Sharpe LLP

(57) ABSTRACT

A buttpad assembly for use on a firearm includes a base wall, a cushion body and a guard element. A firearm buttstock assembly is also included that has a buttstock body and a buttpad assembly. A method of assembling a firearm buttstock assembly is also included.

21 Claims, 7 Drawing Sheets

FIREARM BUTTSTOCK ASSEMBLY AND METHOD

This application is a divisional application of U.S. application Ser. No. 12/411,610, filed on Mar. 26, 2009, which is hereby incorporated herein by reference in its entirety.

INCORPORATION BY REFERENCE

Firearm buttstocks that are displaceable along a firearm between a collapsed position and an extended position are generally known, such as those described in U.S. Pat. Nos. 6,925,744 and 7,363,740 issued to the present inventor, each of which is hereby incorporated herein by reference in its entirety.

BACKGROUND

The subject matter of the present disclosure broadly relates to the art of firearms and, more particularly, to a buttstock assembly for a firearm that provides increased strength and/or performance in comparison with known buttstock constructions. A buttpad assembly for use on such a buttstock assembly and a method of assembling a firearm buttstock are also described.

It is generally believe to be desirable to reduce the weight of firearms that are hand carried as weapons, such as by military and/or law enforcement personnel, for example. This is advantageous because such weight reductions can permit additional equipment to be carried in place of the weight that has been eliminated. For example, firearm buttstocks have been developed that include compartments for carrying additional, alternative and/or replacement components for the firearm, such as additional batteries for an electronic instrument or laser sight, for example. Alternately, any weight reductions that are achieved can simply reduce the overall load that is being carried. This, of course, is also advantageous.

Many known buttstocks for firearms are produced from polymeric materials, rather than being constructed from metal. The use of polymeric materials can be beneficial for balancing factors such as weight of the buttstock assembly, manufacturing costs associated with the production of the buttstock assembly and performance characteristics of the buttstock assembly. As such, firearm buttstocks manufactured from polymeric materials are well known and widely used. Notwithstanding the common usage and overall success of such known polymeric buttstocks, some issues remain that undesirably effect the durability and robustness of firearm buttstocks formed from polymeric materials.

It is well known that firearm buttstocks are used as a bracing point to steady and control a firearm during use. For example, the buttstock is often used as a shoulder brace, such as when the weapon is being fired from a standing, sitting or kneeling position. For this reason, firearm buttstocks commonly include a cushion or butt pad that is secured on a distal end wall of the buttstock.

As another example, the buttstock can rested on a supporting surface to steady the firearm, such as when the firearm is being discharged from a prone position. It will be appreciated that any available supporting surface may be used under such conditions and that the supporting surface is often a hard, rough surface, such as dirt, rock or concrete, for example. Under these conditions, the bottom surface of the buttstock that is resting on the supporting surface can become worn due to abrasion and actions engagement with the hard, rough surface. Accordingly, it is desirable to develop a firearm buttstock assembly that is capable of providing improved wear performance and/or characteristics under such conditions of use. It is also believed desirable to provide such improved wear performance and/or characteristics without substantially increasing the weight of the buttstock assembly.

It is also well known that equipment carried by military and law enforcement personnel can be employed for a wide variety of alternative uses in addition to the primary purpose or use of the particular piece of equipment. In the case of a firearm, it will be appreciated that military and/or law enforcement personnel will often use the buttstock of a rifle to deliver impact forces, in addition to using the weapon in the normally intended manner (i.e., to fire projectiles). For example, military and/or law enforcement personnel may use the buttstock to force an object into a desired position, to smash a window or door or to strike an opponent in close quarters combat.

Known firearm buttstocks that are formed from polymeric materials are well suited for balancing factors such as weight, cost and performance associated with normal use conditions of a firearm. Unfortunately, known firearm buttstocks are less well suited for the various alternative conditions of use to which the buttstocks are often put, such as delivering impact forces, for example. As such, it is believe desirable to develop a firearm buttstock construction that improves the strength and robustness of firearm buttstocks, such as those formed from polymeric materials, for example. It is also believed desirable to provide this increased strength and/or robustness without substantially increasing the weight of the buttstock assembly.

BRIEF DESCRIPTION

One example of a buttpad assembly in accordance with the subject matter of the present disclosure for use in association with a firearm buttstock can include a base wall that extends longitudinally between opposing first and second ends. The base wall also includes opposing first and second sides. A cushion body is disposed along the first side of the base wall. A guard element includes an element wall that extends between a first end and a second end spaced from said first end. The element wall includes an outer surface extending between the first and second ends. The first end of the guard element is supported on the base wall such that at least a portion of the outer surface projects longitudinally outwardly beyond the first end of the base wall and thereby forms an outermost longitudinal extent of the buttpad assembly.

One example of a firearm buttstock assembly in accordance with the subject matter of the present disclosure can include a buttstock body and a buttpad assembly. The buttstock body having a nominal length, a nominal width and a nominal height. The buttstock body includes a body wall at least partially defining a first passage extending lengthwise along the buttstock body. An end wall extends in an approximately transverse orientation to the first passage between a first end and a second end that is spaced from the first end in a heightwise direction. A bottom wall is disposed in spaced relation to the body wall in a heightwise direction. The buttpad assembly is disposed along the end wall of the buttstock body and includes a base wall that extends longitudinally between opposing first and second ends. The base wall includes opposing first and second sides with the first side disposed in abutting engagement with the end wall of the buttstock body. A cushion body is disposed along the second side of the base wall. A guard element is operatively connected to the base wall. The guard element projects outwardly from the base wall and the cushion body beyond the bottom wall of the buttstock body. In this manner, the guard element forms an outermost extent of the firearm buttstock assembly in the heightwise direction.

One example of a method of assembling a firearm buttstock in accordance with the subject matter of the present disclosure can include providing a buttstock body having a nominal length, a nominal width and a nominal height. The buttstock body also includes a body wall that at least partially defines a first passage extending lengthwise along the buttstock body. An end wall extends in an approximately transverse orientation to the first passage between a first end and a second end that is spaced from the first end in a heightwise direction. A bottom wall is disposed in spaced relation to the body wall in a heightwise direction. The method also includes providing a buttpad assembly that includes a base wall extending longitudinally between opposing first and second ends. The base wall also includes opposing first and second sides. A cushion body is disposed along the first side of the base wall. A guard element is operatively connected to the base wall. The guard element projects outwardly from the base wall and the cushion body. The method further includes positioning the buttpad assembly along the buttstock body such that the second side of the base wall is in abutting engagement with the end wall of the buttstock body and the guard element projects outwardly beyond the bottom wall of the buttstock body. In this manner, the guard element forms an outermost extent of the firearm buttstock assembly in the heightwise direction. The method also includes securing the buttpad assembly on the buttstock body.

DETAILED DESCRIPTION

Figure 1:
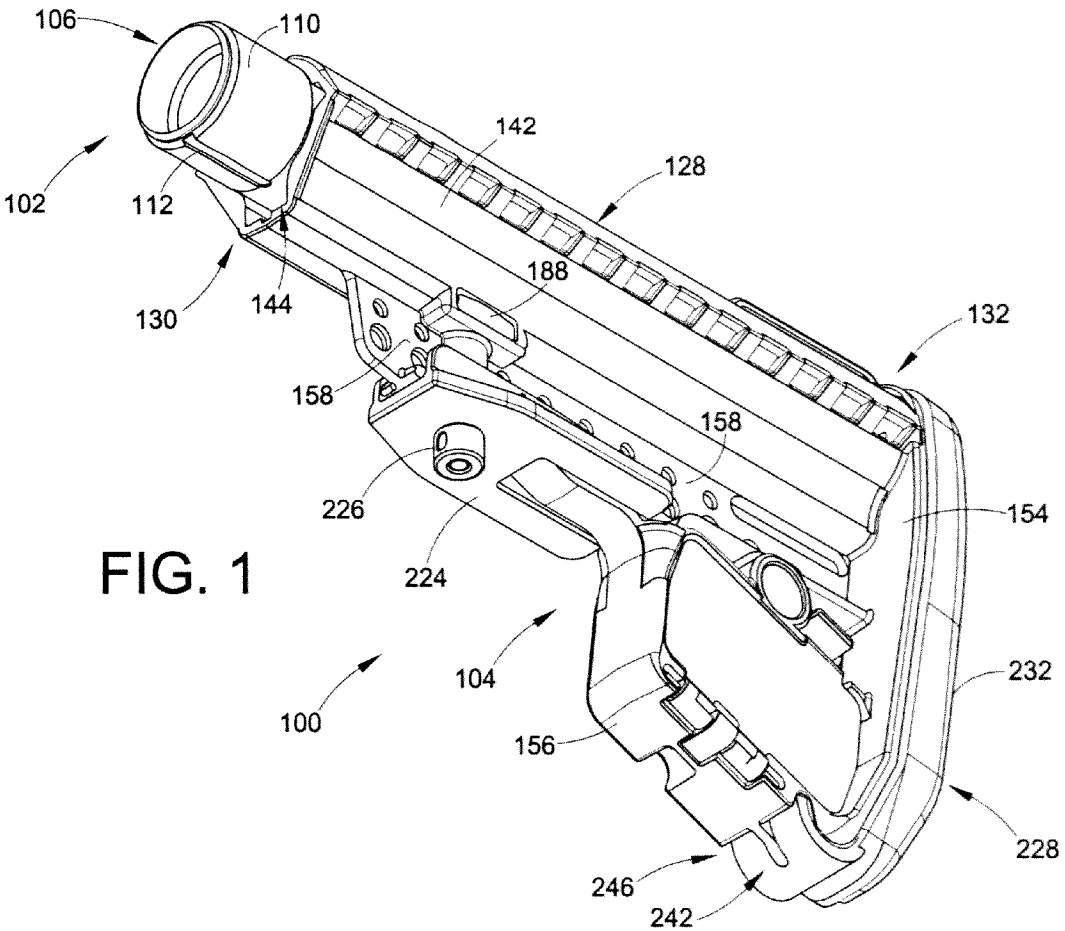
FIG. 1 is a bottom perspective view of a portion of a firearm including a receiver extension and one example of a buttstock assembly in accordance with the subject matter of the present disclosure.
Figure 2:
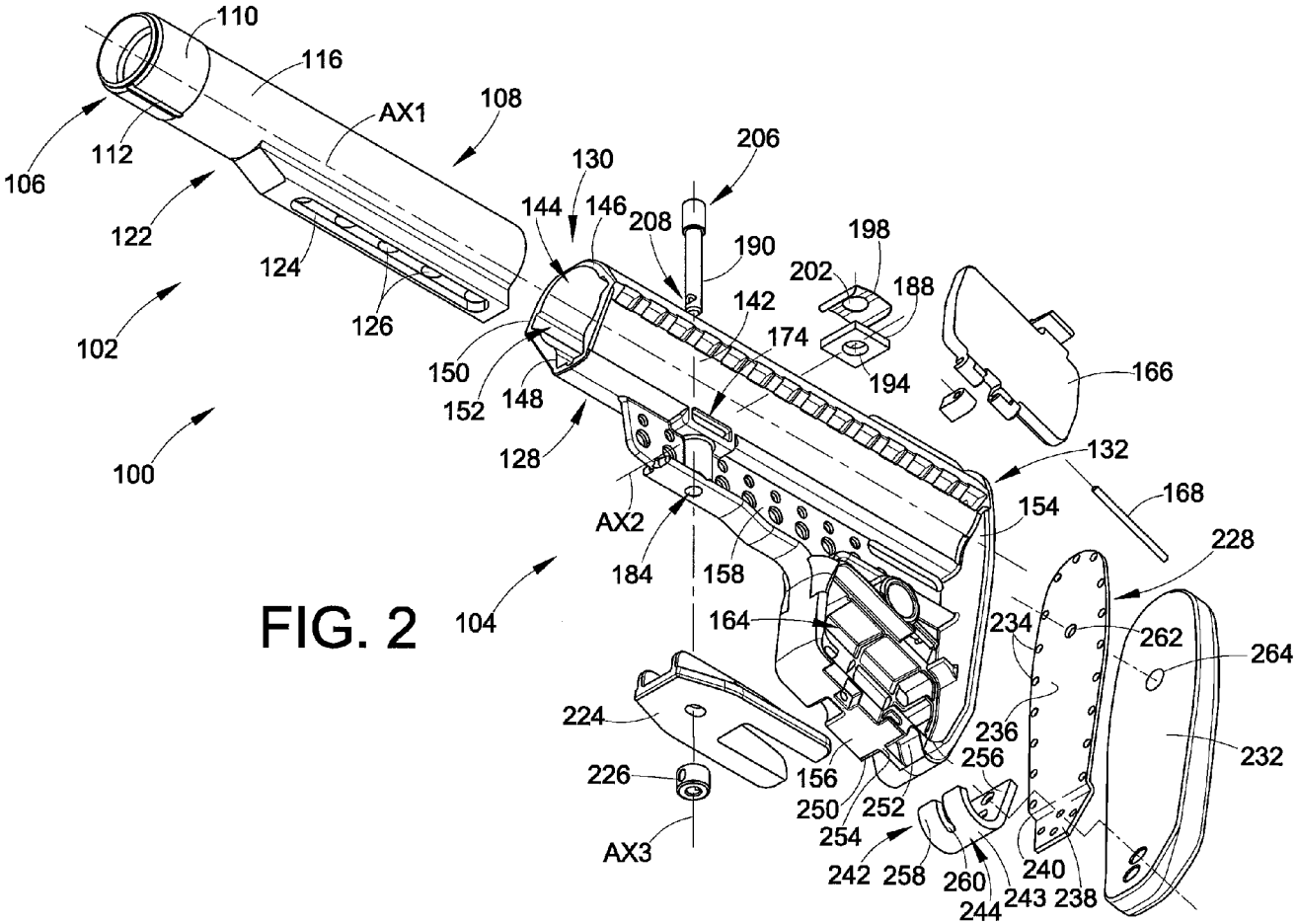
FIG. 2 is an exploded view of the receiver extension and exemplary buttstock assembly shown in FIG. 1.
Figure 3:
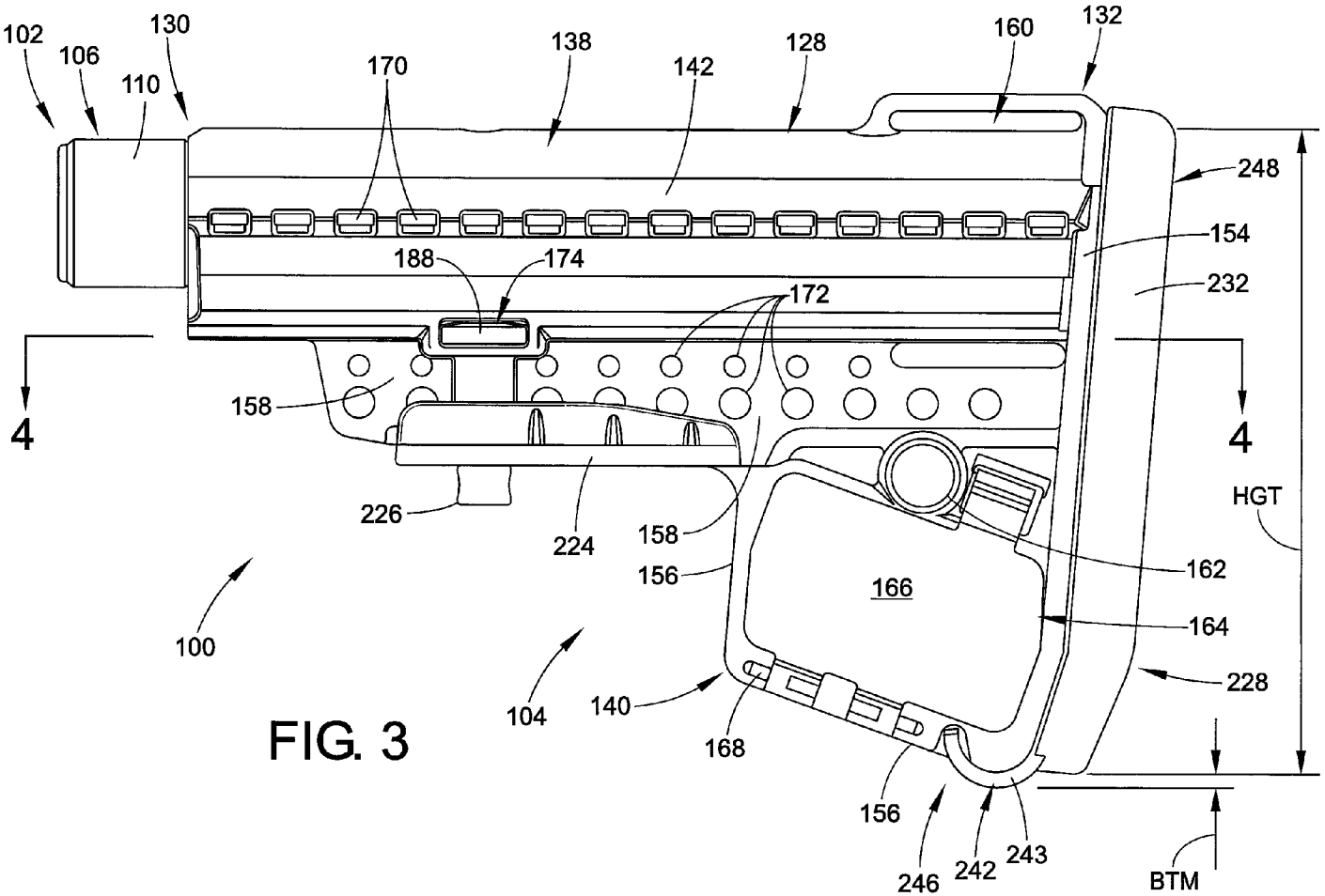
FIG. 3 is a side view of the receiver extension and exemplary buttstock assembly shown in FIGS. 1 and 2.

Turning now to the drawings, wherein the showings are for the purpose of illustrating exemplary embodiments of the subject matter of the present disclosure only and not for the purposes of limiting the same, FIGS. 1-7 illustrate a firearm 100 that includes a receiver extension 102 and a buttstock assembly 104 supported on the receiver extension. It will be recognized that the subject matter of the present disclosure is capable of broad use on or otherwise in connection with a wide variety of firearms of different types, kinds, configurations, constructions and/or arrangements, such as, for example, may be produced by different manufacturers and/or as different models from any particular manufacturer. As such, it is to be understood that the particular embodiment shown and described herein is merely one example of a suitable firearm and buttstock assembly, and that a firearm and/or buttstock assembly of any other type, kind, configuration, construction and/or arrangement in accordance with the subject matter of the present disclosure could alternately be used.

As shown herein, receiver extension 102 extends longitudinally between opposing first and second ends 106 and 108. First end 106 is adapted to connect to a receiver (not shown) of firearm 100 in a conventional manner, such as by using a plurality of interengaging threads 110 and an alignment feature (e.g., a keyway or slot) 112, for example. Receiver extension 102 also includes a first wall 114 that extends longitudinally between first end 106 and second end 108. The exemplary embodiment shown, first wall 114 has an outer surface 116 that defines an approximately cylindrical cross-sectional outer shape of at least a portion of the receiver extension and an inner surface 118 that at least partially defines a passage 120 extending lengthwise through at least a portion of the receiver extension. It will be appreciated that receiver extensions, such as receiver extension 102, for example, are generally known and that the same often take the form of hollow tubes, such as is shown in the present exemplary embodiment. It will be appreciated, however, that alternate constructions can optionally be used.

Receiver extension 102 is also shown as including an alignment rail 122 that extends longitudinally along the first wall 114. Alignment rail 122 projects radially outwardly from outer surface 116 and has a somewhat rectangular-shaped cross section. An elongated slot 124 is formed into the alignment rail and a plurality of retaining features is provided within slot 124. The plurality of retaining features is shown as including openings or cavities 126 that extend inwardly into alignment rail 122 and are disposed in longitudinally-spaced relation to one another along the length of slot 124 formed in the alignment rail.

Figure 4:
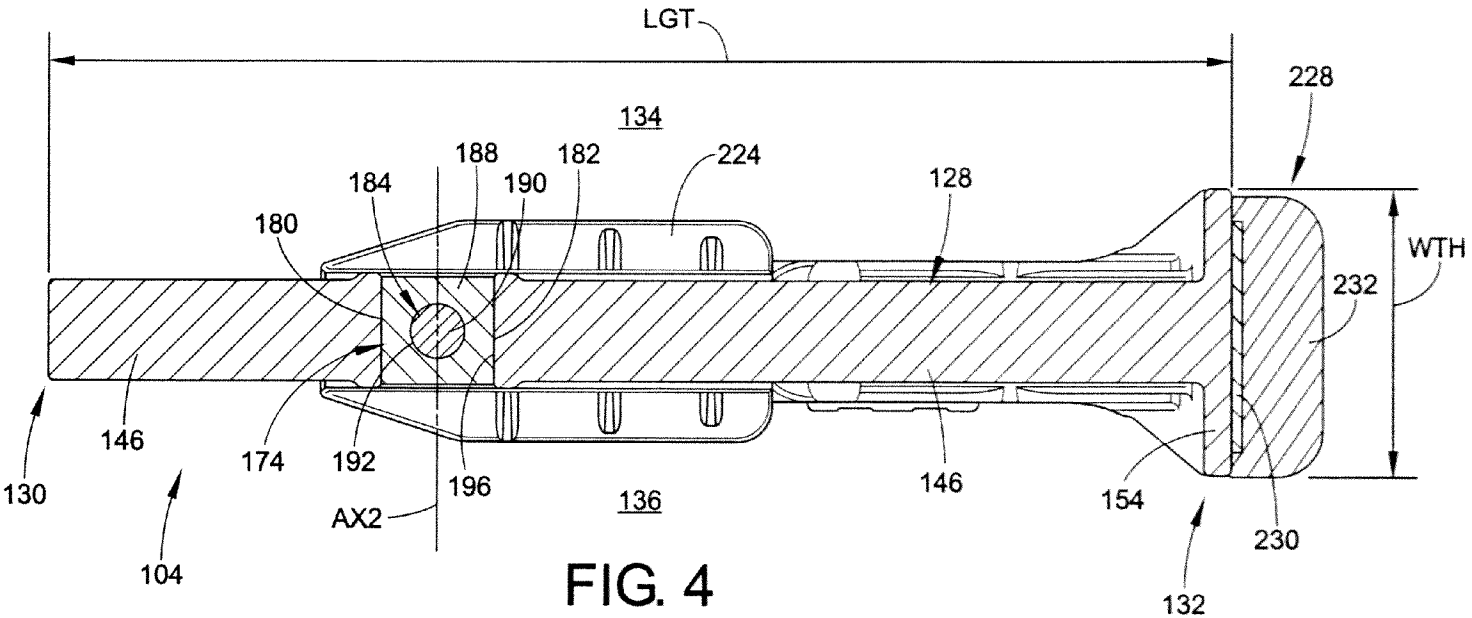
FIG. 4 is a cross-sectional view of the exemplary buttstock assembly shown in FIGS. 1-3 taken along line 4-4 in FIG. 3.
Figure 5:
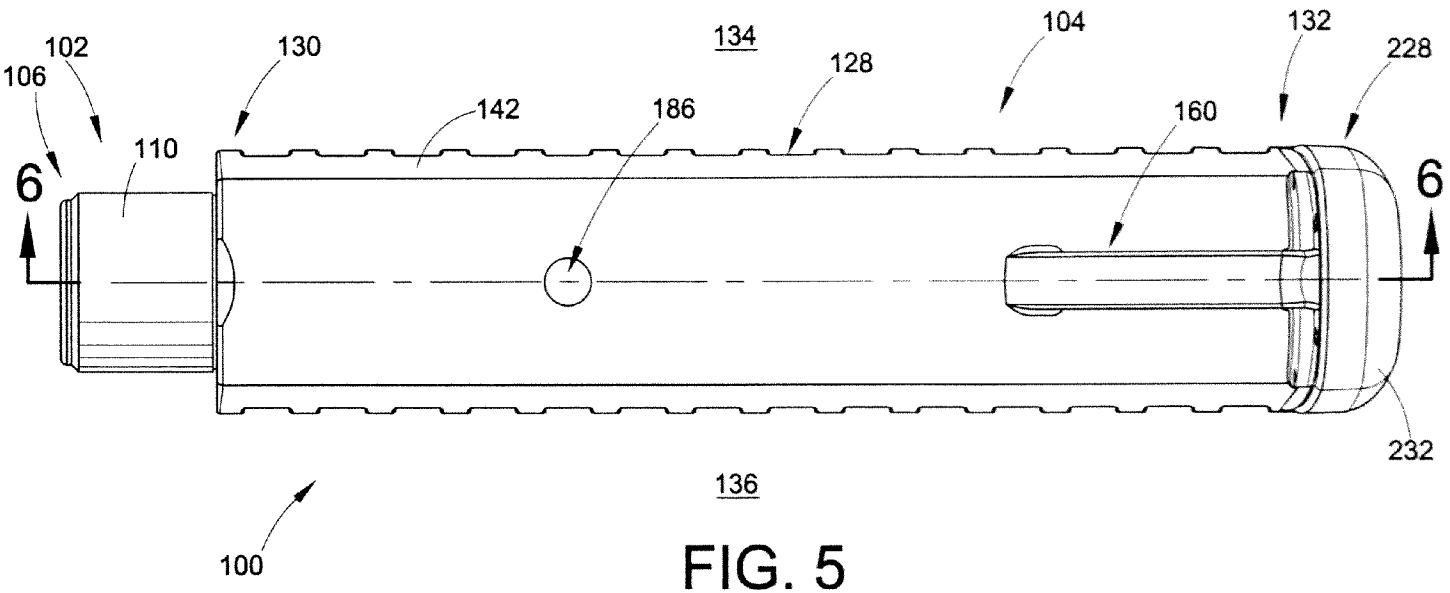
FIG. 5 is a top view of the receiver extension and exemplary buttstock assembly shown in FIGS. 1-4.
Figure 6:
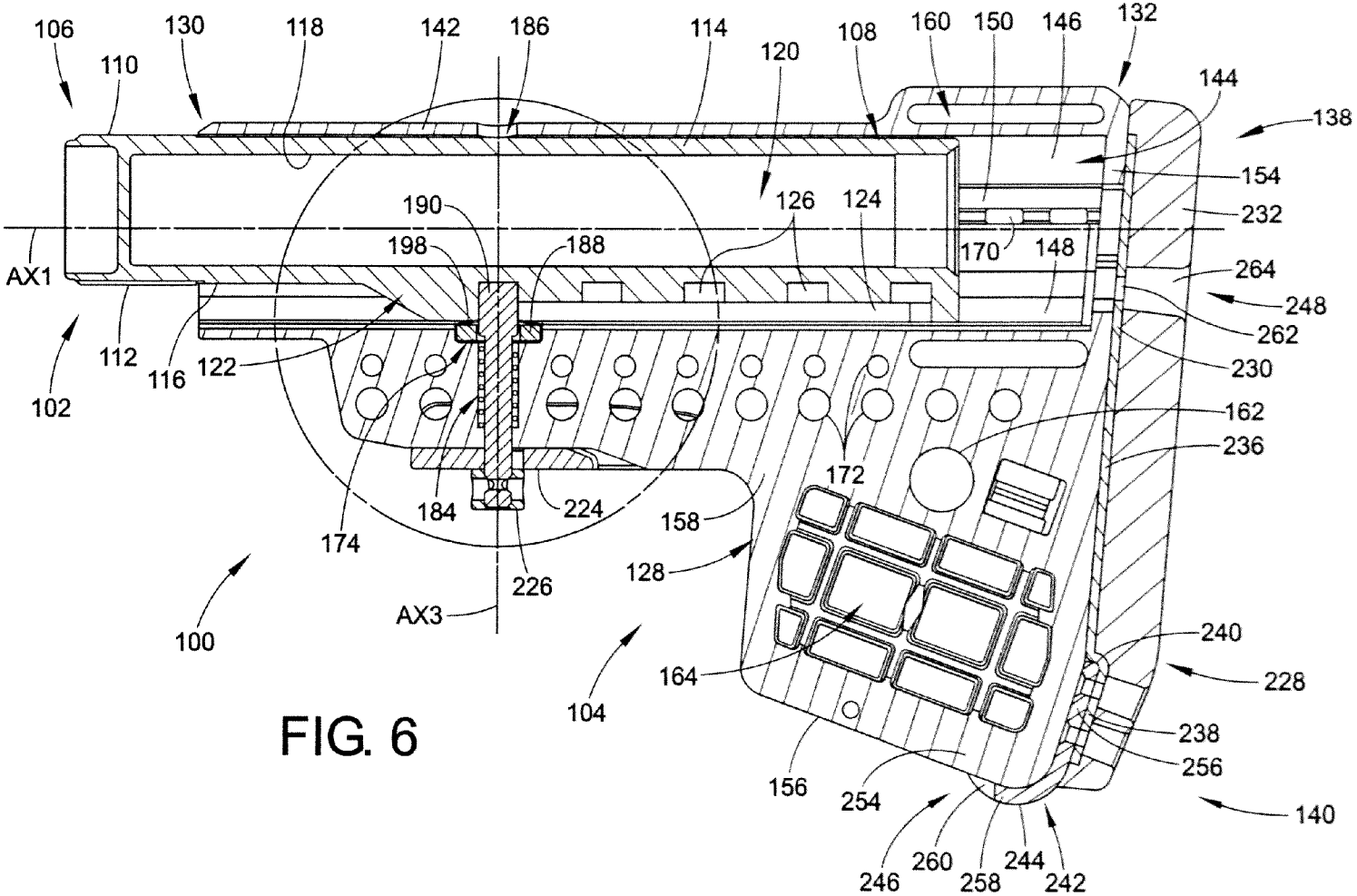
FIG. 6 is a cross-sectional side view of the receiver extension and exemplary buttstock assembly shown in FIGS. 1-5 taken along line 6-6 in FIG. 5.
Figure 7:
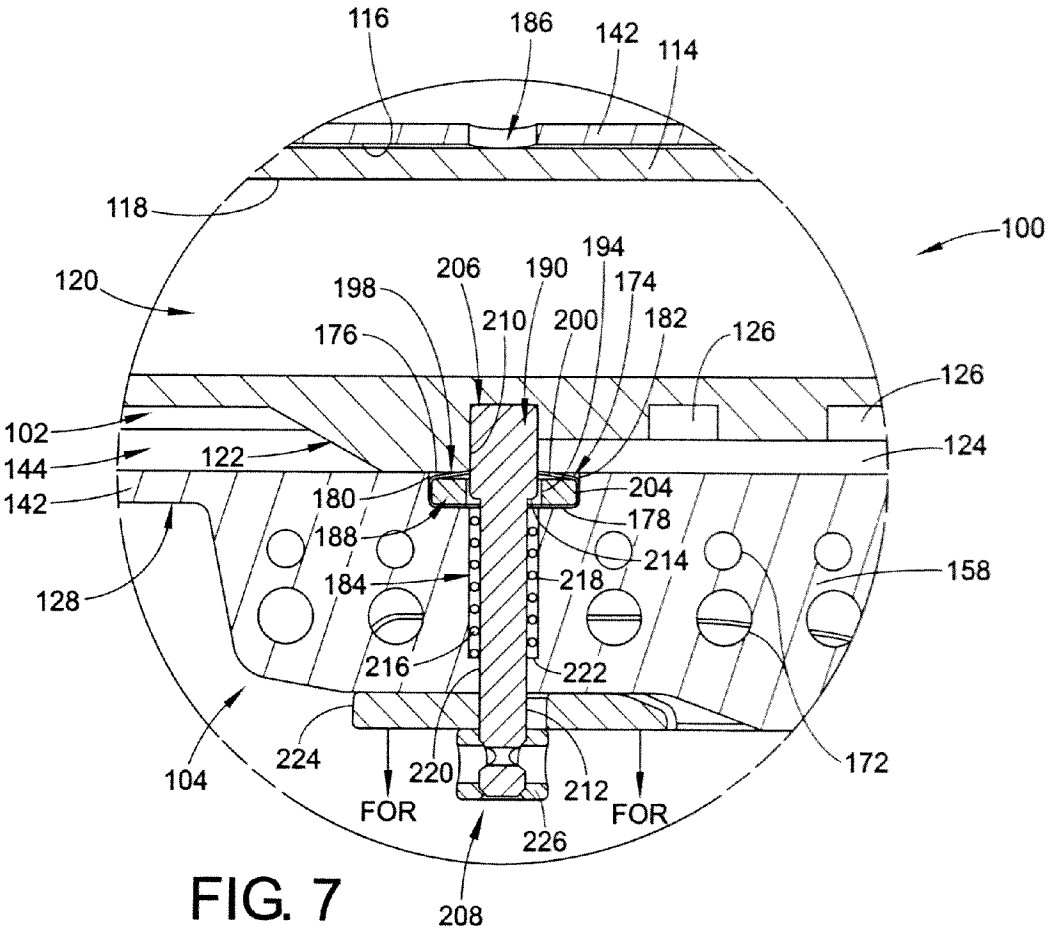
FIG. 7 is an enlarged portion of the receiver extension and exemplary buttstock assembly identified in Detail 7 of FIG. 6.

Buttstock assembly 104 is shown as including a buttstock body or frame 128 that extends longitudinally between a first frame end 130 and an opposing second frame end 132 such that a nominal overall length of the buttstock frame is generally defined therebetween, as is indicated by reference dimension LGT in FIG. 4. Buttstock frame 128 also includes opposing first and second sides, which are generally identified by item numbers 134 and 136 in FIG. 4 and at least partially define a nominal overall width of the buttstock frame, as is indicated by reference dimension WTH in FIG. 4. Furthermore, buttstock frame 128 extends in a generally heightwise direction between a top portion and a bottom portion, which are generally identified in FIG. 3 by item numbers 138 and 140 and at least partially define a nominal overall height of the buttstock frame, as is indicated by reference dimension HGT in FIG. 3.

Buttstock body 128 includes body wall 142 that at least partially defines a first passage 144 extending lengthwise between first and second ends 130 and 132 of the buttstock body. First passage 144 has a longitudinally-extending axis AX1 and is adapted to cooperatively receive receiver extension 102. As shown herein, first passage 144 has a cross-sectional shape that is at least partially defined by a first wall portion 146 and a second wall portion 148. In a preferred arrangement, first wall portion 146 at least partially defines an approximately cylindrically-shaped portion of passage 144 that is complimentary to outer surface 116 of first wall 114 of the receiver extension. Additionally, second wall portion 148 at least partially defines an approximately rectangularly-shaped portion of passage 144 that is complimentary to alignment rail 122 of the receiver extension. Furthermore, other wall portions can also, optionally, be included. For example, first passage 144 can also be at least partially defined by third wall portions 150 that are disposed on opposing sides of the buttstock body and at least partially define longitudinally-extending grooves 152.

Buttstock body 128 is also shown as including an end wall 154 that is disposed in approximately transverse relation (e.g., perpendicular) to axis AX1 and a bottom wall 156 that extends along bottom portion 140 of the buttstock body. A connecting wall or web 158 acts to generally interconnect body wall 142, end wall 154 and bottom wall 156. Buttstock body 128 can also optionally include one or more additional features and/or components. For example, buttstock body 128 is shown as including an elongated slot 160 disposed along top portion 138, such as may be used to receive a strap or harness (not shown), for example. As another example, an opening 162 can extend through or otherwise be provided on connecting web 158, such as could be used to receive a swivel fitting connector (not shown) for a strap or harness, for example. As a further example, a compartment 164 could be formed into connecting web 158 adjacent end wall 154 and/or bottom wall 156. Buttstock body 128 could also include a cover 166 for the compartment and any one or more additional features for securing the cover on or along the connecting web, bottom wall and/or end wall, such as a hinge pin 168, for example. As still another example, buttstock body 128 could include a series of longitudinally spaced openings 170 formed through body wall 142 in communication with grooves 152. A corresponding plurality of longitudinally spaced holes 172 could be formed through connecting web 158. Openings 170 and holes 172 can be used to selectively mount and secure one or more accessories on either or both sides of buttstock body, such as has been described in detail in U.S. Pat. Nos. 6,925,744 and 7,363,740, for example, which are issued to the subject inventor and have been incorporated herein by reference, each in its entirety.

Buttstock body 128 also includes a second passage 174 that extends in an approximately transverse orientation (e.g., perpendicular) to first passage 144. Second passage 174 has a second axis AX2 and is shown extending in a generally widthwise direction through buttstock body 128 between first and second sides 134 and 136 such that an open end (not numbered) of second passage 174 is formed along each of first and second sides 134 and 136. In an alternate arrangement, the second passage could extend into the buttstock body from only one of the first and second sides, such that the second passage would only include one open end, Second passage 174 can be of any suitable size, shape, arrangement and/or configuration. For example, in the exemplary arrangements shown, second passage 174 is defined within buttstock body 128 by a first or upper surface 176 disposed toward top portion 138 of the buttstock body and a second or lower surface 178 disposed in spaced relation to the first surface in a heightwise direction toward bottom portion 140 of the buttstock body. In one preferred embodiment, the first and second surfaces of second passage 174 extend approximately lengthwise along the buttstock body and approximately widthwise between the first and second sides of the buttstock body. Additionally, second passage 174 can be formed or otherwise at least partially defined by a first or forward side wall 180 disposed toward first end 130 and a second or rearward side wall 182 disposed in spaced relation to the first side wall in a lengthwise direction toward second end 132. In one preferred embodiment, the first and second side walls extend widthwise between the first and second sides of the buttstock body and in a heightwise direction toward the top and bottom portions of the buttstock body.

Buttstock body 128 further includes a third passage 184 that extends in an approximately transverse orientation (e.g., perpendicular) to first passage 144 and second passage 174. Third passage 184 has a third axis AX3 and is shown extending in a generally heightwise direction through buttstock body 128. In a preferred arrangement, third passage 184 will extend between a first open end (not numbered) in communication with first passage 144 and a second open end (not numbered) formed along bottom wall 156. Third passage 184 also extends through second passage 174 such that the first and second passages can be in communication with one another through the third passage. In one exemplary arrangement, third passage 184 is approximately cylindrical. It will be appreciated, however, that any other shape and/or configuration could alternately be used. Buttstock body 128 can optionally include a fourth passage 186 that extends through first wall portion 146 of body wall 142 in approximate alignment with third passage 184.

Buttstock assembly 104 also includes a transfer member 188 and a retaining member 190 that is adapted to abuttingly engage transfer member 188, such as, for example, to transmit forces acting on the retaining member to buttstock body 128 through transfer member 188. Transfer member 188 can be of any suitable size, shape, form and/or configuration and is preferably cooperative with second passage 174 such that the transfer member can be at least partially received therein. In the exemplary arrangement shown and described herein, transfer member 188 includes an inner side wall 192 that at least partially defines an opening 194 extending through the transfer member. Transfer member 188 also includes at least one outer side wall that at least partially defines an outer peripheral shape of the transfer member. As shown herein, transfer member 188 has a plurality of outer side walls 196 defining a generally rectangular (e.g., square) shape. In a preferred arrangement, at least one outer side wall of the transfer member will abuttingly engage a side wall of the second passage such that longitudinally-acting forces can be transferred between buttstock body 128 and retaining member 190 through abutting engagement with transfer member 188.

Buttstock assembly 104 can also, optionally, include a biasing member operatively connected between buttstock body 128 and transfer member 188. It will be appreciated that a biasing member of any suitable type, kind, configuration and/or construction could be used. For example, in the embodiment shown herein, the biasing member includes a spring element 198 that includes a spring wall 200 having an opening 202 formed therethrough. Spring element 198 is also shown as including a pair of opposing retaining walls 204 that are adapted to abuttingly engage transfer member 188. The biasing member can be operatively connected between the buttstock body and the transfer member in any desired manner, such as by inserting spring element 198 into second passage 174 between transfer member 188 and one of upper and lower surfaces 176 and 178, for example. In a preferred arrangement, opening 202 is positioned in approximate alignment with third passage 184 such that retaining member 190 can extend through spring element 198 together with transfer member 188.

Retaining member 190 can be of any suitable size, shape, configuration and/or arrangement for retractably engaging receiver extension 102. In the exemplary arrangement shown herein, retaining member 190 extends longitudinally between opposing first and second ends 206 and 208. Retaining member 190 is at least partially received in third passage 184 and is oriented therein such that first end 206 is in communication with first passage 144 and second end 208 projects outwardly from buttstock body 128 along bottom portion 140 thereof. As such, it will be recognized that retaining member 190 extends through opening 194 in transfer member 188 and opening 202 of spring element 198, if provided.

Retaining member 190 is shown as including a first outer surface 210 disposed toward first end 206 and a second outer surface 212 disposed toward second end 208. First outer surface 210 is preferably of a size and shape that is complimentary to cavities 126 formed in receiver extension 102 and opening 194 formed in transfer member 188. As shown, first outer surface 210 at least partially defines a first portion (not numbered) of the retaining member that has an approximately cylindrical shape. Second outer surface 212 is preferably of a size and shape that is complimentary to third passage 184 such that the retaining member can be displaced in a heightwise direction therealong. In the exemplary arrangement shown, second outer surface 212 at least partially defines a second portion (not numbered) of the retaining member that has an approximately cylindrical shape but has a cross-sectional dimension that is less than the cross-sectional dimension of the portion formed by first outer surface 210. As such, a shoulder wall 214 can be provided that extends radially between first and second outer surfaces 210 and 212. It will be appreciated, however, that any other shape, configuration and/or arrangement of outer surfaces could alternately be used.

Buttstock assembly 104 can also optionally include a biasing member that is operatively connected between buttstock frame 128 and retaining member 190 to bias or otherwise urge first end 206 of the retaining member toward first passage 144 of the buttstock frame. It will be appreciated that a biasing member of any suitable type, kind, configuration and/or construction could be used. For example, in the embodiment shown herein, the biasing member includes a spring element 216 (FIG. 7) that is compressively positioned between buttstock frame 128 and shoulder wall 214 of retaining member 190. In a preferred arrangement, third passage 184 will include a first portion 218 that has a cross-sectional dimension complimentary with first outer surface 210 of the retaining member and a second portion 220 that has a cross-sectional dimension complimentary with second outer surface 212 of the retaining member such that a shoulder wall 222 extends radially therebetween. In such case, spring element 216 can be a compression-type coil spring dispose between shoulder wall 214 of the retaining member and shoulder wall 222 of the buttstock body. It will be appreciated, however, that any other arrangement and/or configuration could alternately be used.

As described above, retaining member 190 is retractably disposed within third passage 184 such that first end 206 is biased or otherwise urged toward first passage 144 to abuttingly engage slot 124 and cavities 126. This permits buttstock assembly 104 to be longitudinally disposed in any one of two or more different positions along receiver extension 102 of firearm 100. To permit the buttstock assembly to be displaced from a first position to a second position, retaining member 190 is retracted in a heightwise direction a sufficient distance to permit the second end of the retaining member to disengage the cavities of the receiver extension. It will be appreciated that the retaining member can be retracted in any suitable manner, such as by applying a force to the retaining member in a heightwise direction, as is indicated by arrow FOR in FIG. 7. It will be appreciated that such a force can be applied in any suitable manner. As one example, buttstock assembly 104 can also, optionally, include a retraction member 224 that can be received on second end 208 of retaining member 190 and secured thereto in any suitable manner, such as by using a threaded nut 226 to engage a plurality of threads (not numbered) on the second end of the retaining member, for example.

Buttstock assembly 104 can be assembled in any suitable manner. For example, buttstock frame 128 can be provided that includes first passage 144, second passage 174 and third passage 184. Transfer member 188 can also be provided and inserted into second passage 174 until opening 194 in the transfer member is in approximate alignment with third passage 184. Optionally, a biasing member, if provided, can be inserted into second passage 174 together with transfer member 188. Retaining member 190 can then be inserted into third passage 184 in any suitable manner, As one example, fourth passage 186 can be of sufficient size to permit first end 206 of retaining member 190 to pass through the fourth passage and into third passage 184. In such case, retaining member 190 can be oriented such that second end 208 is disposed toward top portion 138 and first end 206 is disposed outwardly and away from the top portion. The retaining member can then be axially displaced through fourth passage 186 and into third passage 184 such that the retaining member extends through opening 194 in transfer member 188 and second end 208 projects outwardly from bottom portion 140 of buttstock body 128. A biasing member, if provided, can be installed within third passage 184 (or, alternately, along second outer surface 212 of the retaining member) prior to insertion of the retaining member into the third passage. A retraction member, such as retraction member 224, for example, can then be secure on second end 208 of the retaining member in any suitable manner, such as by way of threaded nut 226, for example.

During use, first outer surface 210 of first end 206 is in abutting engagement with one of cavities 126 as well as inner side wall 192 of transfer member 188. Additionally, at least a portion of at least one outer side wall (e.g., one of outer side walls 196) of transfer member 188 is in abutting engagement with a corresponding side wall of buttstock body 128 (e.g., a corresponding one of side walls 180 and 182). This arrangement permits a force applied to the buttstock (e.g., an impact load due to an alternative use of the firearm) to be transmitted through buttstock frame 128 to transfer member 188. Inner side wall 192 of the transfer member engages first outer surface 210 of first end 206 of retaining member 190 to transfer at least a portion of the force to the retaining member. The retaining member can then react the force into firearm 100 through abutting engagement with one of cavities 126 of receiver extension 102. Forces acting in the opposing direction (e.g., forces due to recoil) would be transferred to the buttstock body in the same manner.

Buttstock assembly 104 can also include a buttpad assembly 228 that can act as a cushion for bracing firearm 100. However, buttpad assembly 228 differs from other known buttpad constructions in that buttpad assembly 228 includes feature that acts as a strike guard and wear surface for the buttstock assembly. It will be appreciated that a buttpad assembly in accordance with the subject matter of the present disclosure can be of any suitable type, kind, arrangement, configuration and/or construction and that any other features and/or element can also be included thereon.

In the exemplary arrangement shown herein, buttpad assembly 228 includes a base wall 230 adapted to extend longitudinally along at least a portion of end wall 154 of buttstock body 128. Additionally, base wall 230 extends widthwise across the end wall and can, optionally, include the approximate outer peripheral shape of at least a portion of end wall 154. Buttpad assembly 228 also includes a cushion or pad 232 that extends along and across base wall 230. It will be appreciated that base wall 230 and cushion 232 can be formed from any suitable materials or combination of materials. As one example, base wall 230 can be formed from a substantially rigid material, such as a high strength polymer or a metal, for example, and cushion 232 can be formed from a compliant material, such as a thermoplastic elastomer, for example. Additionally, it will be appreciated that cushion 232 can be secured on or along base wall 230 in any suitable manner. As one example, cushion 232 could be secured on or along base wall 230 using a suitable securement feature or element, such as a threaded fastener or an adhesive, for example. As another example, base wall 230 could include a plurality of holes 234 formed therethrough and cushion 232 could be over-molded onto base wall 230 with a portion of the material used to form the cushion flowing into holes 234 to secure the cushion on the base wall.

More specifically, base wall 230 is shown as including a first portion 236 that can be substantially planar or otherwise complimentary to end wall 154 and a second portion 238 that is spaced lengthwise from the first portion. Second portion 238 is shown as being disposed at an angle AG1 relative to first portion 236. It will be appreciated that any suitable angle can be used. For example, angle AG1 could be within a range of approximately 5 degrees to approximately 85 degrees. Additionally, second portion 238 is shown as being offset from first portion 236 such that a shoulder portion 240 extends therebetween.

Buttpad assembly 228 also includes a guard element 242 that extends from base wall 230 toward and along bottom portion 140 of buttstock body 128. Guard element 242 includes an element wall 243 having an outer surface 244 that is preferably positioned as the bottommost surface of buttstock assembly 104, as is generally represented by reference dimension BTM (FIG. 3), such that outer surface 238 can be used as a rest for contacting a supporting surface (e.g., dirt, rock and concrete) during use of the firearm. As such, it is desirable for guard element 242 to be formed from a material having suitable wear resistance and/or other desirable strength and abrasion resistance properties. As one example, guard element 242 could be formed from metal (e.g., steel and aluminum).

It will be appreciated that guard element 242 can be formed or otherwise provided in any suitable manner. For example, the guard element could be formed together with base wall 230 such that an integral base wall and guard element component is provided. As another example, guard element 242 can be provided as a separate component, as is shown herein, and secured or otherwise attached to base wall 230 using suitable securement features and/or devices, such as threaded or non-threaded fasteners, adhesive and/or a flowed material joint (e.g., a welded or brazed joint), for example. One benefit of using such a two-part construction is that a robust guard element can be provided while adding minimal weight to the buttstock assembly.

It will be appreciated that buttpad assembly 228 can be secured on or along buttstock body 128 in any suitable manner. As one example, buttpad assembly 228 can be secured on buttstock body 128 at a first or lower point 246 along bottom portion 140 of the buttstock body and at a second or upper point 248 spaced heightwise from the first point toward top portion 138 of buttstock body 128. In the exemplary arrangement shown, bottom wall 156 that extends along bottom portion 140 of buttstock 128 includes an opening formed therein that is suitable for receiving and abuttingly engaging guard element 242. As shown, bottom wall 156 includes a first opening or cavity 250 formed along one side of the buttstock body and a second opening or cavity 252 formed along the opposing side of the buttstock body such that an intermediate wall 254 is disposed therebetween.

Guard element 242 is preferably cooperable with the one or more openings provided in buttstock body 128 to secure buttpad assembly 228 thereon at or along first mounting point 246. In the exemplary arrangement shown, guard element 242 is somewhat J-shaped and forms a hook that is adapted to engage the buttstock body. Guard element 242 includes a first wall portion 256 that is adapted for connection to base wall 230, such as has been described above, and a second wall portion 258 disposed at the opposite end of the guard element from first wall portion 256. A slot or groove 260 is formed into second wall portion 258 such that two end portions or hooks are formed from second wall portion 258. Preferably, slot 260 is complimentary to intermediate wall 254 such that the intermediate wall can be received within the slot as the hooks formed on second wall portion 258 are received into first and second openings 250 and 252. The interengagement of the hooks formed by second wall portion 258 with openings 250 and 252 in the buttstock body acts to restrict at least longitudinal displacement of the buttpad assembly along bottom portion 140 and the interengagement of intermediate wall 254 with the hooks formed by second wall portion 258 acts to restrict widthwise movement of the buttpad assembly. In this manner, buttpad assembly 228 can be secured on or along buttstock body 128 at first mounting point 246.

As mentioned above, buttpad assembly 228 can be secured on or along buttstock frame 128 at second mounting point 248 in any suitable manner. As one example of a suitable mounting arrangement, base wall 230 can include a mounting hole 262 that is disposed in approximate alignment with a suitable securement feature (not shown) to engage buttstock body 128. It will be appreciated that such a securement feature can be provided separately or integrally formed on the buttstock body. Cushion 232 can include an access cavity 264 formed therein that permits a suitable securement device (not shown) to be installed through mounting hole 262 to engage the buttstock body or separate securement feature supported thereon. In this manner, buttpad assembly 228 can be releasably secured on the buttstock body and can be removed for replacement or repair.

As used herein with reference to certain elements, components and/or structures (e.g., "first end" and "second end"), numerical ordinals merely denote different singles of a plurality and do not imply any order or sequence unless specifically defined by the claim language.

While the subject novel concept has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles of the subject novel concept. Obviously, modifications and alterations will occur to others upon reading and understanding the preceding detailed description. Accordingly, it is to be distinctly understood that the foregoing descriptive matter is to be interpreted merely as illustrative of the present novel concept and not as a limitation, As such, it is intended that the subject novel concept be construed as including all such modifications and alterations insofar as they come within the scope of the appended claims and any equivalents thereof.

The invention claimed is:

1. A buttpad assembly for a firearm buttstock, said buttpad assembly comprising:

a base wall extending longitudinally between opposing first and second ends and including opposing first and second sides;

a cushion body disposed along said first side of said base wall; and, a guard element including an element wall that extends between a first end and a second end spaced from said first end, said element wall including an outer surface extending between said first and second ends, said first end of said guard element supported on said base wall such that at least a portion of said outer surface projects longitudinally outwardly beyond said first end of said base wall and thereby forms an outermost longitudinal extent of said buttpad assembly;

wherein said element wall includes a first wall portion disposed toward said first end, a second wall portion disposed toward said second end, and a groove extending into said second wall portion from along said second end.

2. A buttpad assembly according to claim 1, wherein said cushion body includes a distal end that extends longitudinally outwardly beyond said first end of said base wall, and at least a portion of said outer surface of said guard element projects longitudinally outwardly beyond said first end of said base wall and said distal end of said cushion body.

3. A buttpad assembly according to claim 2, wherein said base wall includes a passage adapted to receive an associated securement device and said cushion body includes an opening formed therein in communication with said passage.

4. A buttpad assembly according to claim 1, wherein said first end of said guard element is disposed in abutting engagement with said base wall along said second side thereof.

5. A buttpad assembly according to claim 1, wherein said base wall includes a first wall portion that is substantially planar and a second wall portion that is disposed at a non-zero angle relative to said first portion.

6. A buttpad assembly according to claim 5, wherein said angle is within a range of from 5 degrees to 85 degrees.

7. A buttpad assembly according to claim 1, wherein said base wall includes a first wall portion that is substantially planar and a second wall portion that is offset from said first wall portion such that a shoulder wall portion is formed between said first and second wall portions.

8. A buttpad assembly according to claim 7, wherein said first end of said element wall of said guard element is disposed adjacent said shoulder wall portion of said base wall.

9. A buttpad assembly according to claim 1, wherein said base wall is formed from a first material and said guard element is at least partially formed from a second material that is different from said first material.

10. A buttpad assembly for a firearm buttstock, said buttpad assembly comprising:

a base wall extending longitudinally between opposing first and second ends and including opposing first and second sides;

a cushion body disposed along said first side of said base wall; and, a guard element including an element wall that extends between a first end and a second end spaced from said first end, said element wall including an outer surface extending between said first and second ends, said first end of said guard element supported on said base wall such that at least a portion of said outer surface projects longitudinally outwardly beyond said first end of said base wall and thereby forms an outermost longitudinal extent of said buttpad assembly;

wherein said element wall includes a first wall portion disposed toward said first end and a second wall portion disposed toward said second end, said first wall portion being substantially planar, and said second wall portion being curved such that said guard element has a J-shaped cross section.

11. A buttpad assembly according to claim 1, wherein said element wall includes an outer periphery and a plurality of holes extending through said element wall in spaced relation to one another along said outer periphery.

12. A buttpad assembly dimensioned for securement on an associated firearm buttstock having an associated end wall extending between opposing top and bottom ends and an associated bottom wall oriented transverse to the associated end wall, said buttpad assembly comprising:

a base wall extending longitudinally between opposing first and second ends and including opposing first and second sides;

a cushion body disposed along said first side of said base wall; and, a guard element including an outer surface and connected to said base wall such that said guard element projects longitudinally outwardly beyond said base wall and said cushion body and said outer surface forms an outermost longitudinal extent of said buttpad assembly;

said base wall and said guard element dimensioned such that upon securement of said buttpad assembly on an associated firearm buttstock with said base wall oriented along the associated end wall and said guard element oriented along the associated bottom wall said outer surface can form an outermost extent of the associated firearm buttstock extending beyond the bottom end of the associated end wall adjacent the associated bottom wall.

13. A buttpad assembly according to claim 12, wherein said guard element includes an element wall having first end and an opposing second end with said outer surface extending along said element wall between said first and second ends.

14. A buttpad assembly according to claim 13, wherein said first end of said element wall is secured to said base wall and said second end of said element wall is dimensioned to engaged the associated bottom wall of the associated firearm buttstock.

15. A buttpad assembly according to claim 13, wherein said guard element includes a groove extending into said element wall from along said second end.

16. A buttpad assembly according to claim 13, wherein said element wall includes a first wall portion disposed along said first end and a second wall portion disposed along said second end with said first wall portion being approximately planar and said second wall portion being curvilinear such that said guard element has J-shaped cross section.

17. A method of manufacturing a buttpad assembly for a buttstock of a firearm, said method comprising:

providing a base wall extending longitudinally between opposing first and second ends and including opposing first and second sides;

providing a guard element including an element wall that extends between a first end and a second end that is spaced from said first end, said element wall including an outer surface extending between said first and second ends, said element wall including a first wall portion disposed toward said first end, a second wall portion disposed toward said second end, and a groove extending into said second wall portion from along said second end;

securing said guard element on said base wall such that at least a portion of said outer surface projects longitudinally outwardly beyond said first end of said base wall;

providing a cushion extending longitudinally between opposing first and second ends; and, positioning said cushion along said first side of said base wall with said first end of said cushion disposed toward said first end of said base wall and said first end of said cushion space longitudinally from said outer surface of said guard element such that said outer surface of said guard element forms an outermost longitudinal extent of said buttpad assembly.

18. A method according to claim 17 further comprising securing said cushion along said first side of said base wall.

19. A method according to claim 17, wherein said element wall includes a first wall portion disposed along said first end and a second wall portion disposed along said second end with said first wall portion being approximately planar and said second wall portion being curvilinear such that said guard element has J-shaped cross section, and wherein said method further comprises orienting said element wall such that said first wall portion is disposed along said base wall and said second end is spaced longitudinally inwardly from said outermost longitudinal extent of said buttpad assembly.

20. A buttpad assembly for a firearm buttstock, said buttpad assembly comprising:

a base wall extending longitudinally between opposing first and second ends and including opposing first and second sides;

a cushion body disposed along said first side of said base wall; and, a guard element including an element wall that extends between a first end and a second end spaced from said first end, said element wall including an outer surface extending between said first and second ends, said first end of said guard element supported on said base wall such that at least a portion of said outer surface projects longitudinally outwardly beyond said first end of said base wall and thereby forms an outermost longitudinal extent of said buttpad assembly;

wherein said guard element includes a hook adapted for engaging an associated buttstock body.

21. A buttpad assembly according to claim 20, wherein the element wall includes a first wall portion disposed toward said first end and a second wall portion disposed toward said second end, said second wall portion forming the hook.

* * * * *